US006305108B1

(12) United States Patent
Lin

(10) Patent No.: US 6,305,108 B1
(45) Date of Patent: Oct. 23, 2001

(54) STRUCTURAL IMPROVEMENT OF A WATER BALL

(76) Inventor: Hsi-Chun Lin, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 09/376,328

(22) Filed: Aug. 18, 1999

(51) Int. Cl.[7] ..... G09F 19/00

(52) U.S. Cl. ..... 40/406; D26/9; D26/10; 431/289; 40/409

(58) Field of Search ..... 40/406, 409, 410; D26/9, 10, 16, 96; 431/289, 297, 126; 362/447

(56) References Cited

U.S. PATENT DOCUMENTS 1,761,299 * 6/1930 Heisey ..... 431/289 X
3,001,307 * 9/1961 Sieve ..... 40/107
3,806,723 * 4/1974 Ollom ..... 431/289
5,092,065 3/1992 Teng .
5,666,750 * 9/1997 Segan et al. ..... 40/410
5,924,869 * 7/1999 Haas ..... 434/245
6,036,477 * 3/2000 Frandsen ..... 431/289 X
6,165,041 * 12/2000 Lin ..... 40/409 X

* cited by examiner

*Primary Examiner*—Brian K. Green
*Assistant Examiner*—James M Hewitt
(74) *Attorney, Agent, or Firm*—Dougherty & Troxell

(57) ABSTRACT

A structural improvement of a water ball, which comprises mainly a glass ball of a water ball, and the top center of the glass ball has a candle stand for receiving a short candle; the candle stand is made of a material same as that of the glass ball; after a candle is mounted in the candle stand and lit up, the flame thereof and the water ball will provide a decorative atmosphere.

2 Claims, 6 Drawing Sheets

STRUCTURAL IMPROVEMENT OF A WATER BALL

BACKGROUND OF THE INVENTION

1. Field of the Invention

This invention relates to a water ball, and particularly to a water ball with a candle stand on the top thereof for receiving a short candle.

2. Description of the Prior Art

In the conventional water-ball ornament, the neck of the glass ball is closed with a leak-proof rubber plug; the inner center of the glass ball is glued with an ornament; after the glass ball is filled with water, the glass ball will be mounted on a base; the water ball has a convex lens effect to enlarge the ornament therein.

The conventional ornament of the water ball is furnished with a transmission device or a music device in the base so as to provide a dynamic and variable decoration effect of the ornament in the water ball; such ornament may be artificial flakes, or a dynamic windmill, or a rotary ornament.

In a conventional water ball ornament, such as U.S. Patent No. 5,092,065, the top center of the glass ball of the water ball is mounted with a suitable ornament, which is an outer ornament of the water ball.

SUMMARY OF THE INVENTION

The prime object of the present invention is to provide a water ball structure, in which the top center of the glass ball of the water ball is furnished with a candle stand, and the center of the candle stand has a short cylindrical body with a diameter slightly larger than that of a candle so as to facilitate the candle to plug in. In addition to the ornamental effect, the water ball with a candle stand is mounted with a candle in the inner cylinder of the candle stand; after the candle is lighted up, the flame thereof and the ornament of the water ball will provide a combined decorative atmosphere.

Another object of the present invention is to provide a water ball structure, in which the candle stand furnished on the top center of the glass ball is connected together with a circular flat on the top of the glass ball; the upper opening of the cylindrical body of the candle stand is furnished with a petal-shaped rim; the diameter of the inner cylinder of the candle stand is slightly larger than that of the candle so as to facilitate the candle to plug in.

Still another object of the present invention is to provide a water ball structure, in which the candle stand on the top center of the glass ball has a recess hole with a diameter slightly larger than that of the candle so as to facilitate the candle to plug in directly.

A further object of the present invention is to provide a water ball structure, in which the top global surface of the glass ball is attached with a candle stand that has a stem portion, and a short candle is to be plugged in the candle stand.

DETAILED DESCRIPTION OF THE PREFERRED EMBODIMENT

Figure 1:
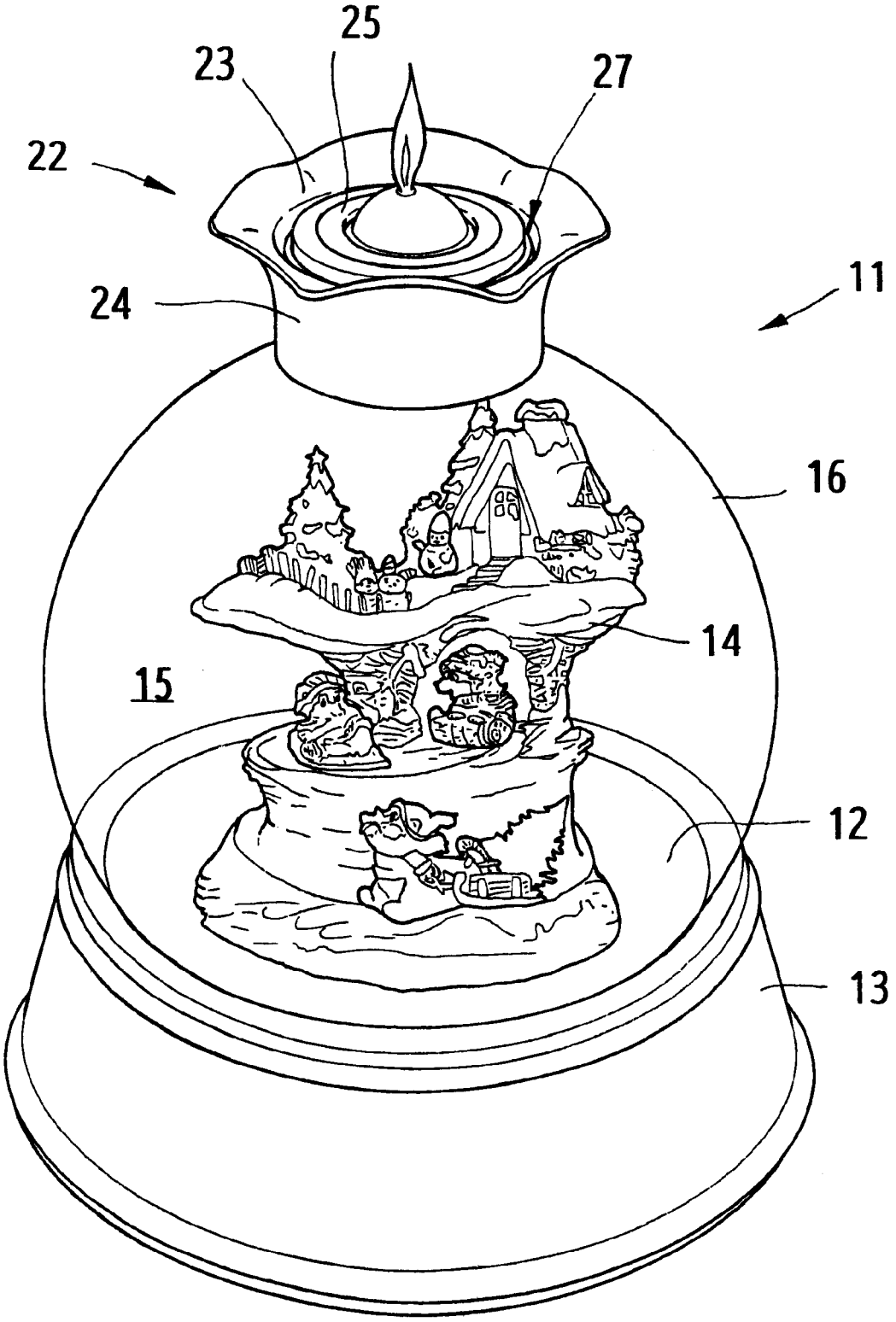
FIG. 1 is a perspective view of the present invention, showing a candle mounted on the top of a water ball.
Figure 2:
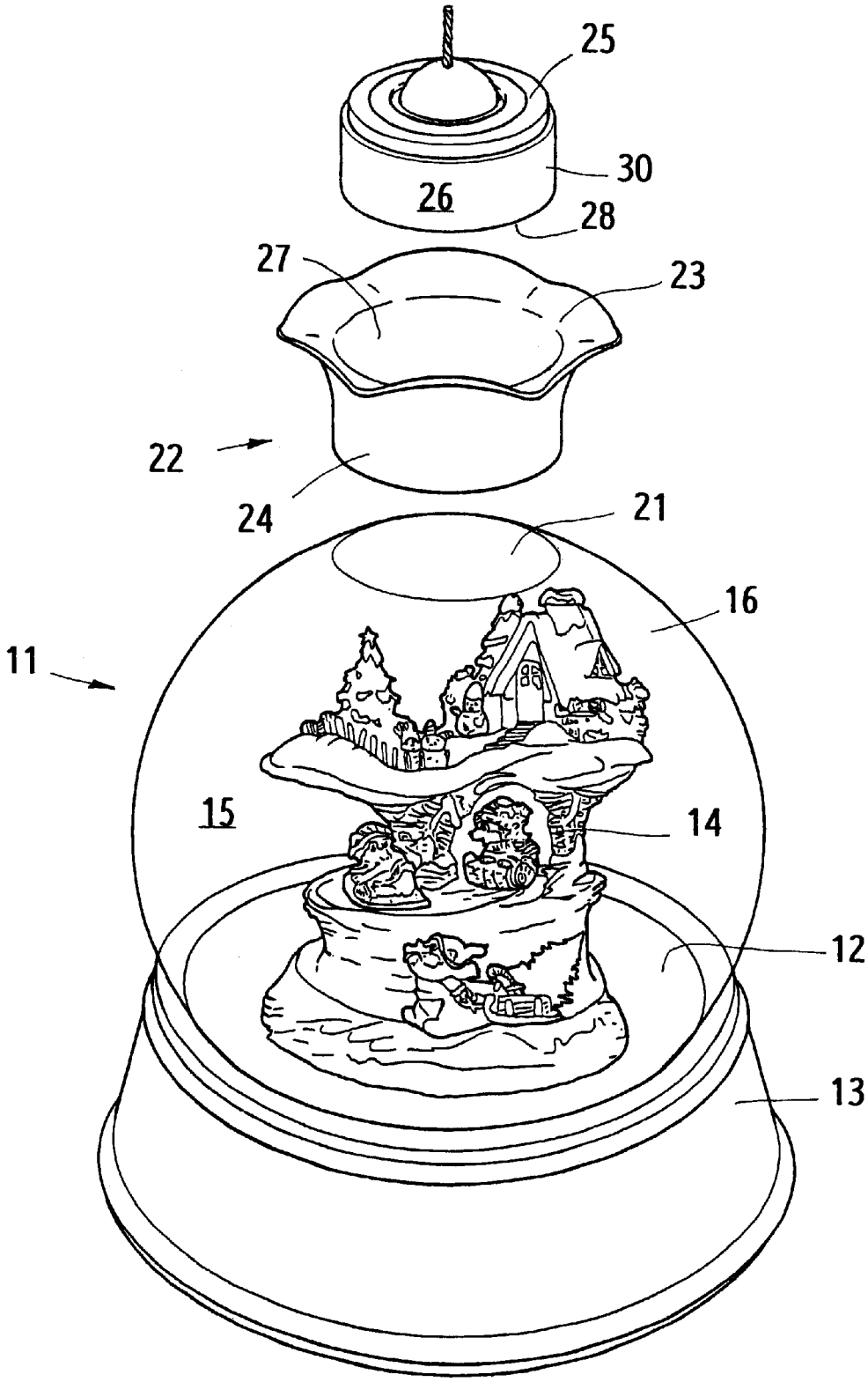
FIG. 2 is a disassembled view of the present invention, showing the relation among parts thereof.
Figure 3:
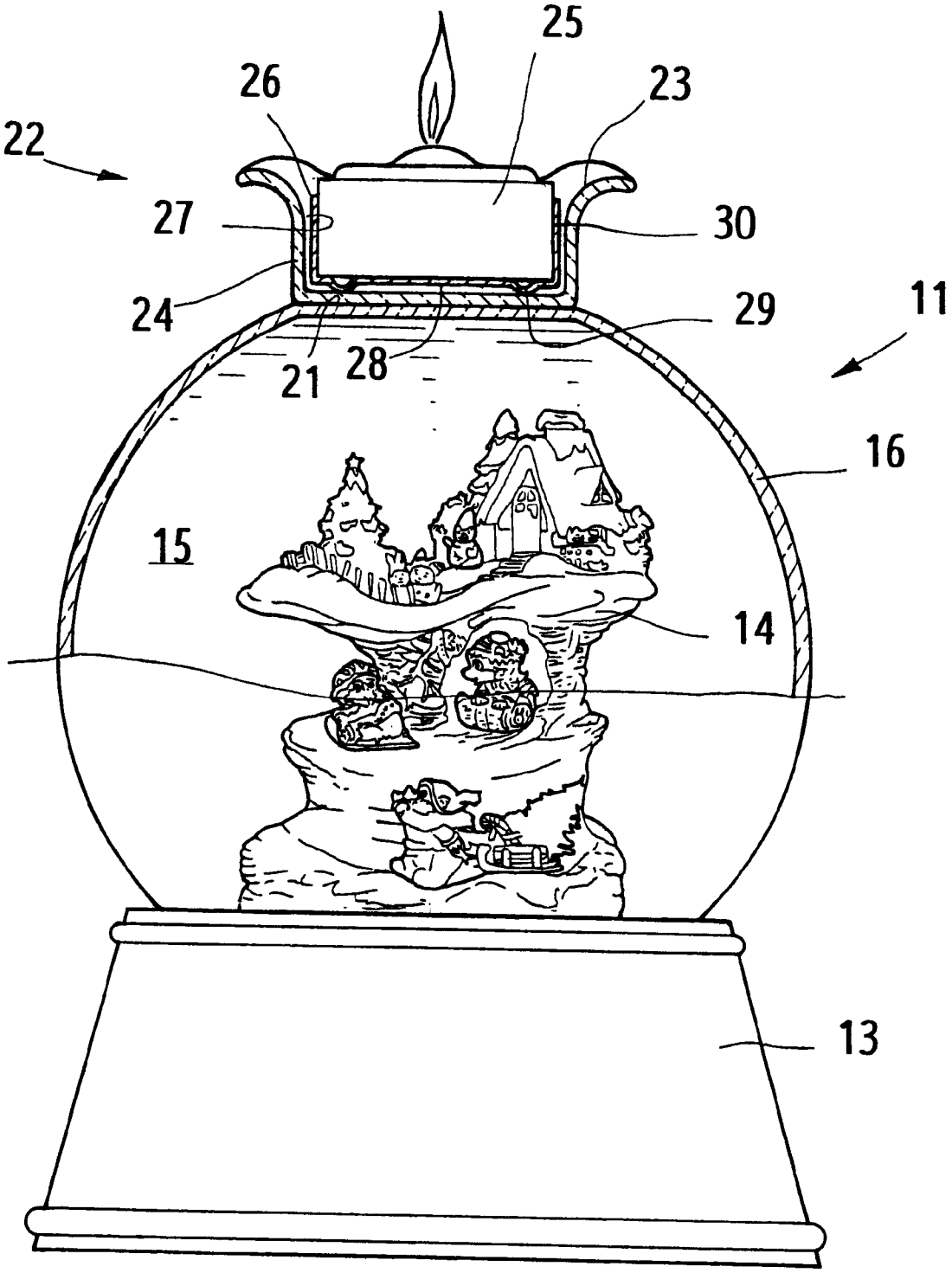
FIG. 3 is a sectional view of the present invention, showing the structural relation between the water ball and the candle stand thereof.

Referring to FIGS. 1 to 3, the present invention relates to the structure of a water ball 11, of which the glass ball 16 is filled with water 15; the top side of the leak-proof rubber plug 12 is mounted and glued with an ornament 14. Before the leak-proof rubber plug 12 and the glass ball 16 are connected together, the water 15 and the ornament 14 are sealed and fixedly mounted in the glass ball 16. The neck part of the glass ball 16 and the base 13 are connected together; after the glass ball is set on a table, the ornament 14 glued to the leak-proof rubber plug 12 looks like being enlarged as a result of the water and the convex lens effect of the glass ball 16 so as to provide an ornament of crystal ball.

The top center of the glass ball 16 is furnished with a candle stand 22, which is substantially a short inner cylinder 27 loaded with a short candle 25. The candle stand 22 on the water ball 11 is made of glass without effecting the ornamental effect of the water ball 11. After the candle 25 is mounted in the candle stand 22 and lighted up, the light of the candle and the water ball will provide more decorative atmosphere.

Figure 4:
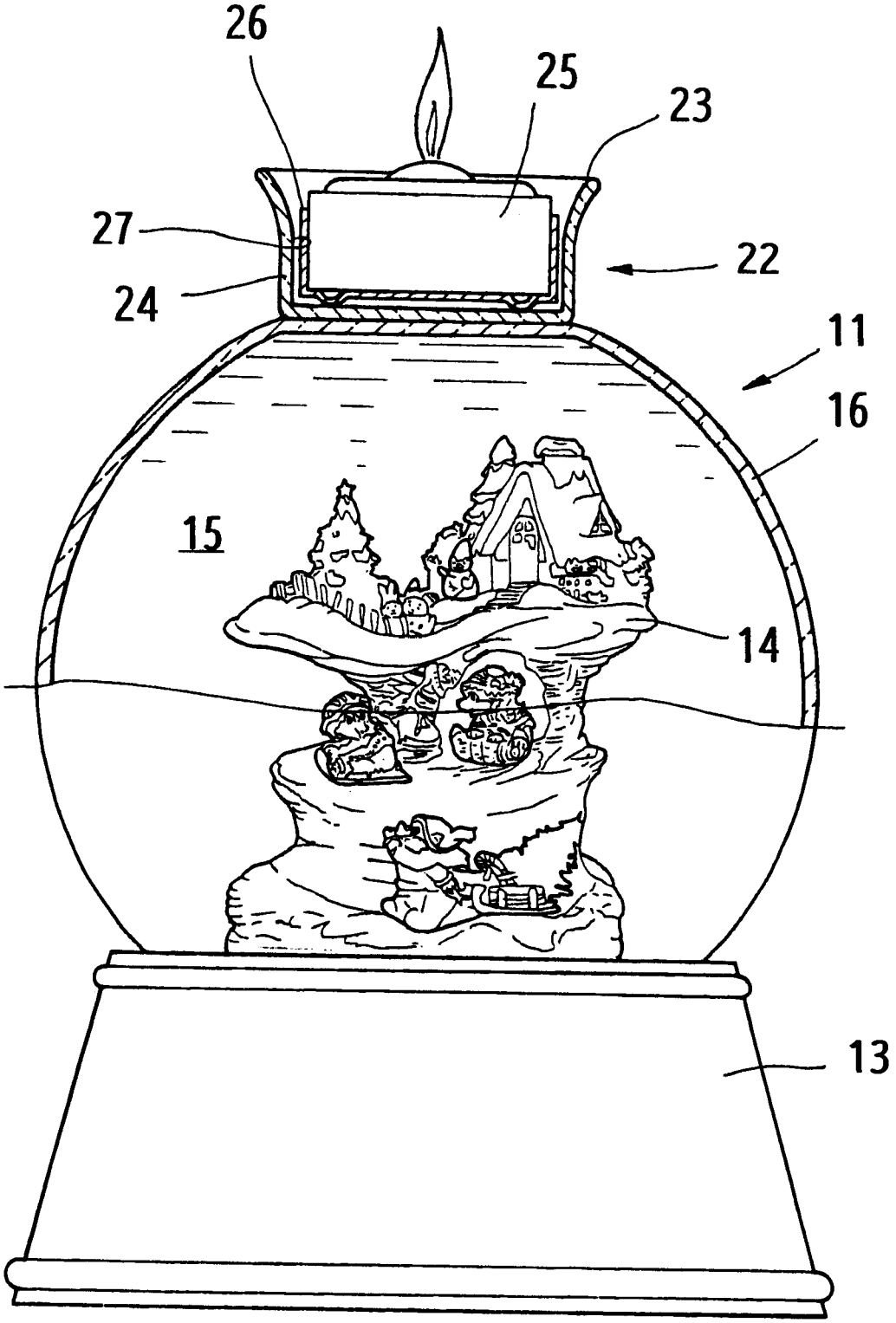
FIG. 4 is a sectional view of the present invention, showing the second embodiment of the candle stand.

As shown in FIGS. 1 to 3, the top center of the glass ball 16 is mounted with a candle stand 22; the candle stand 22 and the glass ball 16 are independent parts respectively. The top center of the glass ball 16 has a circular flat 21, of which the diameter is designed to fit the bottom of the candle stand 22 closely, and they are glued together. The bottom portion of the candle stand 22 is a cylindrical body 24, of which the upper opening 23 is designed into a decorative shape looking like flower petals. The center of the cylindrical body 24 has an inner cylinder 27 for receiving the candle 25. Instead of being flower petals as shown in FIGS. 1 to 3, the upper opening of the cylindrical body 24 may be a simple stem part 34 as shown in FIG. 4; it has an inner cylinder 27 in the candle stand 22. After the candle 25 is lighted up, the flame of the candle will provide a decorative atmosphere.

The candle 25 is mounted in a base container 26 made of metal, and the base container includes a bottom disk 28 and a short cylinder part 30. The bottom disk 28 is furnished with several salient beads 29. The inner surface of the base container 26 is in close contact with the candle 25. After the base container 26 with a candle 25 is mounted in the inner cylinder 27 of the candle stand 22 on the water ball 11, the short cylinder part 30 of the base container 26 is slightly separated from the inner cylinder 27 of the candle stand 22. The bottom disk 28 of the base container 26 can contact with the bottom of the inner cylinder 27 of the candle stand 22 by means of the salient beads 29 only. When the candle 25 is burning, the ambient temperature thereof would not be conducted outwards. The diameter of the inner cylinder 27 in the cylindrical body 24 of the candle stand 22 is slightly longer than that of the candle 25 so as to receive the candle 25 with the base container 26. When the candle 25 is burning, the heat effect would not be conducted outwards.

Figure 5:
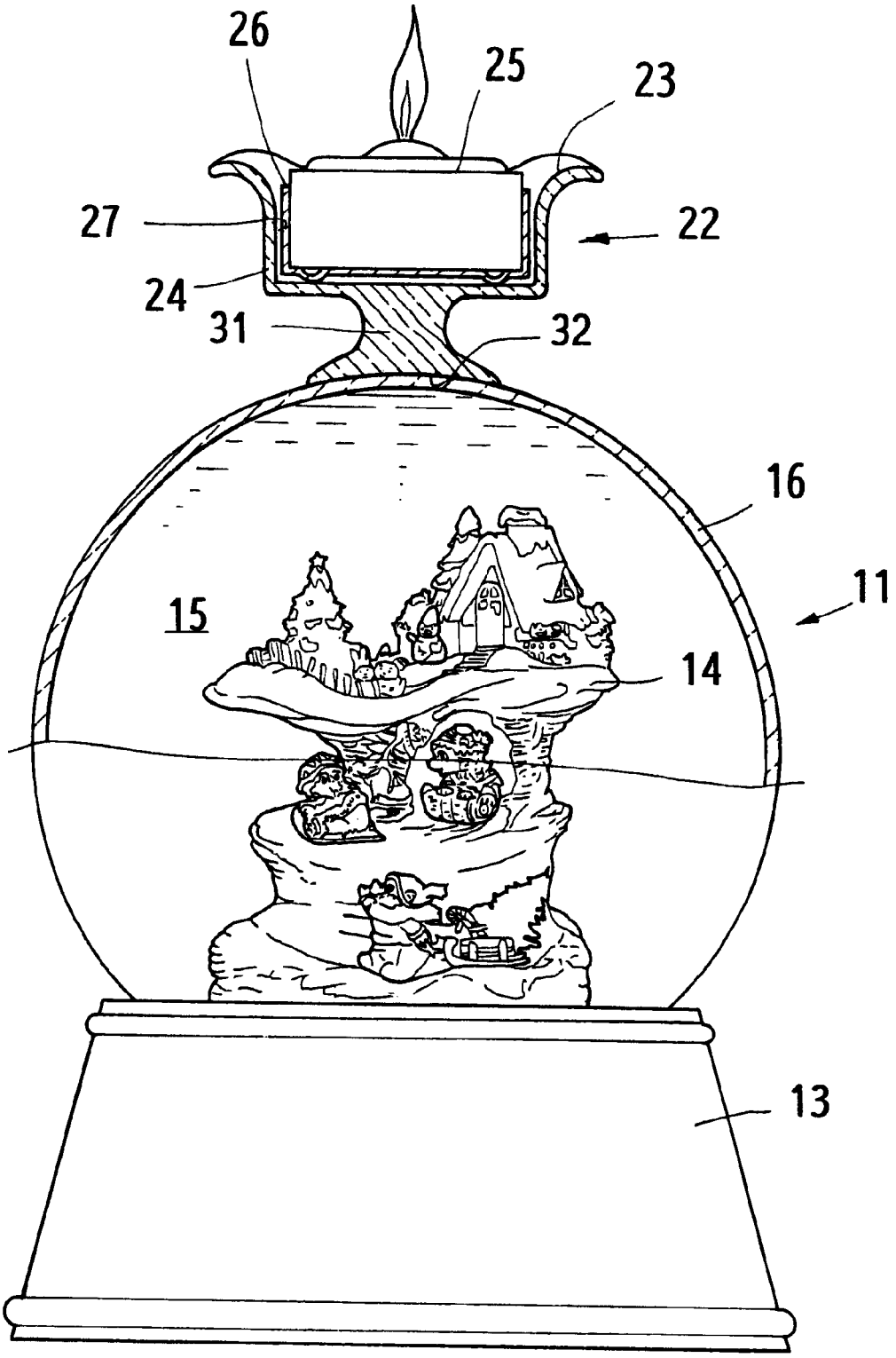
FIG. 5 is a sectional view of the present invention, showing the third embodiment of the candle stand.

The candle stand 22 on the glass ball 16 as shown in FIG. 5 has a stem portion 32 under the bottom thereof; the bottom of the stem portion 32 has a global surface 31 so as to fit the global side of the glass ball 16, and to facilitate the stem portion 32 to be glued on the top center of the glass ball 16; then, the candle 25 can be mounted in the inner cylinder 27 of the candle stand 22.

Figure 6:
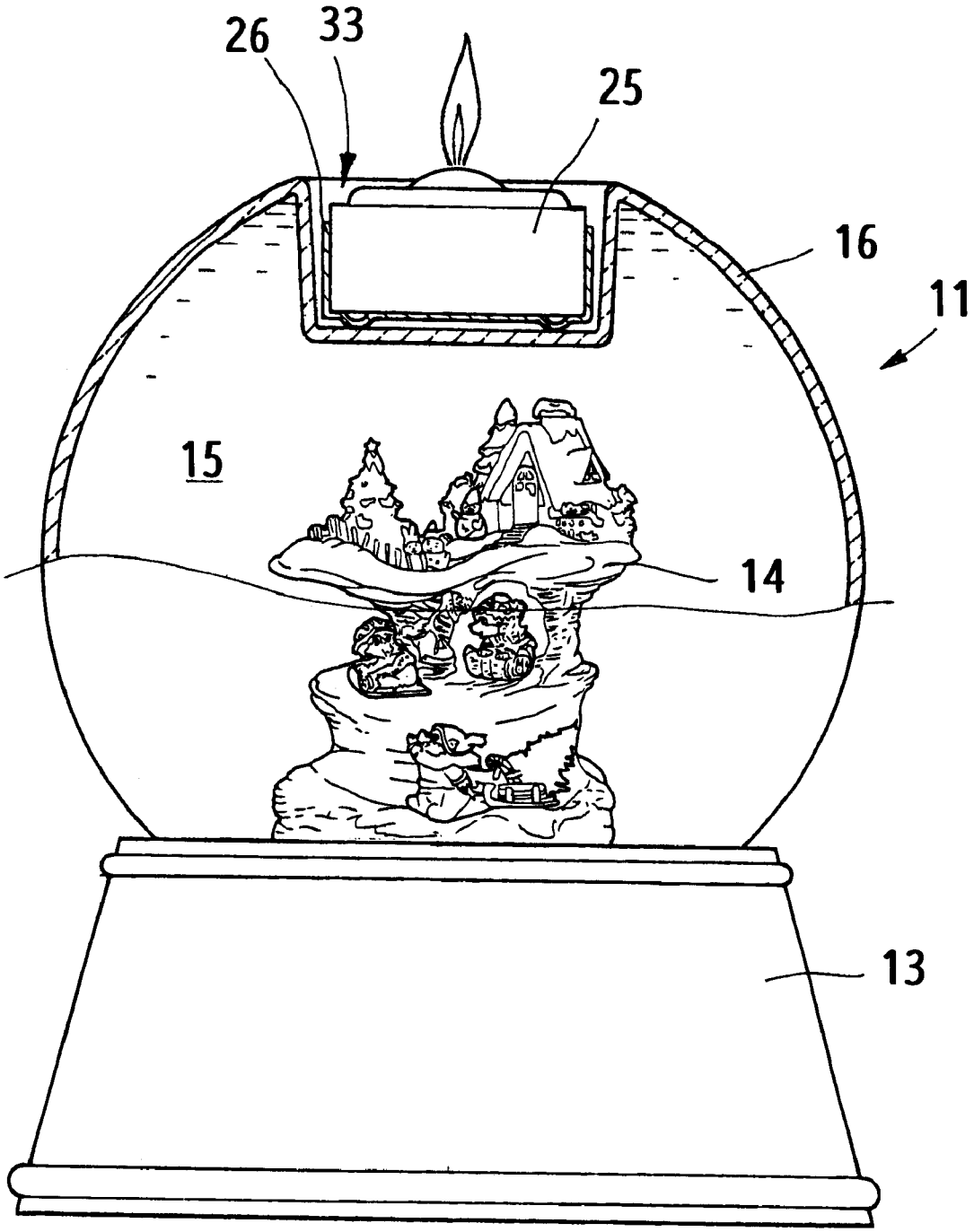
FIG. 6 is a sectional view of the present invention, showing the fourth embodiment of the candle stand.

The stop center of the glass ball 16 has a recess hole 33 as shown in FIG. 6 for receiving the candle stand 22; the diameter of the recess hole 33 is slightly larger than that of the candle 25, and it has a depth to fit the height of the short candle 25. The recess hole 33 and the glass ball 16 are molded into one piece; the recess hole 33 is substantially a candle stand 22 for mounting a candle 25 therein directly.

The water ball 11 according to the present invention has a candle stand 22 furnished on the top center of the glass ball 16 for mounting candle 25 in the inner cylinder 27; the flame of candle 25 will provide a decorative atmosphere. According to the aforesaid description of the embodiments, the structural features among the parts have disclosed an apparent improvement and novelty of the present invention, and the objects desired have been obtained; such features are never shown and anticipated by any person skilled in the field.

What is claimed is:

1. A decorative water ball comprising:

a) a glass ball filled with water;

b) a decorative ornament mounted on a leak-proof rubber plug and sealed within the glass ball;

c) a base mounted to the glass ball;

d) a top center of the glass ball having a circular flat surface; and, e) a candle stand mounted on the circular, flat surface, the candle stand having a short cylindrical body bounding an inner cylinder configured to accommodate a candle therein and an upper opening with a decorative rim.

2. A decorative water ball comprising:

a) a glass ball filled with water;

b) a decorative ornament mounted on a leak-proof rubber plug and sealed within the glass ball;

c) a base mounted to the glass ball;

d) a top center of the glass ball having a spherical surface; and, e) a candle stand mounted on the top center spherical surface, the candle stand having a stem portion with a bottom surface matching and mounted on the top center spherical surface of the glass ball, a short cylindrical body extending from the stem and bounding an inner cylinder configured to accommodate a candle therein and having an upper opening with a decorative rim.

* * * * *